US008555656B2

(12) United States Patent
Al-Qaffas

(10) Patent No.: US 8,555,656 B2
(45) Date of Patent: Oct. 15, 2013

(54) THERMALLY CONDUCTIVE CUP AND HOLDER

(76) Inventor: Qasem A. Al-Qaffas, Alsalam (KW)

( * ) Notice: Subject to any disclaimer, the term of this patent is extended or adjusted under 35 U.S.C. 154(b) by 243 days.

(21) Appl. No.: 12/913,824

(22) Filed: Oct. 28, 2010

(65) Prior Publication Data

US 2012/0102972 A1 May 3, 2012

(51) Int. Cl.
*F25B 21/04* (2006.01)

(52) U.S. Cl.
USPC ..... 62/3.6; 220/592.17

(58) Field of Classification Search
USPC ..... 62/3.3, 3.6, 3.64; 220/62.12, 62.13, 220/62.14, 62.15, 592.16, 592.17, 592.24
See application file for complete search history.

(56) References Cited

U.S. PATENT DOCUMENTS

| | | | | |
|---|---|---|---|---|
| 1,447,180 | A * | 3/1923 | Ployer | 220/573.1 |
| 3,719,505 | A | 3/1973 | Mazza | |
| 3,788,513 | A * | 1/1974 | Racz | 219/438 |
| 3,909,591 | A * | 9/1975 | Ulam | 219/438 |
| 5,718,124 | A * | 2/1998 | Senecal | 62/457.6 |
| 5,724,883 | A | 3/1998 | Usherovich | |
| 7,032,507 | B2 | 4/2006 | Cai | |
| 7,089,749 | B1 | 8/2006 | Schafer | |
| 7,174,720 | B2 * | 2/2007 | Kennedy | 62/3.3 |
| 7,231,142 | B1 | 6/2007 | Leung | |
| RE41,295 | E * | 5/2010 | Cauchy | 62/3.3 |
| 2004/0140304 | A1 * | 7/2004 | Leyendecker | 219/386 |
| 2007/0051248 | A1 | 3/2007 | Lee | |

FOREIGN PATENT DOCUMENTS

| | | | |
|---|---|---|---|
| JP | 02297307 | A * | 12/1990 |
| JP | 2004079560 | A * | 3/2004 |

* cited by examiner

*Primary Examiner* — Allen Flanigan
*Assistant Examiner* — Johan Yavari
(74) *Attorney, Agent, or Firm* — Lowe Hauptman & Ham, LLP

(57) ABSTRACT

A thermally conductive cup and holder for maintaining a temperature of a cold or hot beverage in the cup includes a thermally conductive cup or mug having an open or closed top, a closed bottom and an upper and lower portion between the top and bottom. The lower portion and bottom of the cup are made of a thermally conductive material such as aluminum while the upper portion includes a ceramic layer or coating. The cup holder includes a heat conductive liner engaging the bottom and lower portion of the cup and an on/off switch and a polarity switch to select heat or refrigeration. A thermal electric device maintains a hot or cold beverage at a pre-selected temperature and is connected to a computer or other source of electric power.

1 Claim, 1 Drawing Sheet

THERMALLY CONDUCTIVE CUP AND HOLDER

FIELD OF THE INVENTION

This invention relates to a thermally conductive cup and holder and more particularly to a thermally conductive cup and cup holder for connection to a computer for maintaining a temperature of a beverage in the cup.

BACKGROUND OF THE INVENTION

Household electric machines for brewing and dispensing hot and cold beverages are known and have been in use for many years. For example, a Mazza U.S. Pat. No. 3,719,505 discloses a machine for the preparation of both hot and cold beverages. The machine is characterized in that it comprises a receptacle for at least one cartridge containing an ingredient in solid or concentrated liquid form, for the preparation of a beverage. The machine includes a mechanism for rupturing the cartridge and for establishing communication between the cartridge and a source of liquid, which has been conditioned for the preparation of the beverage concerned, a refrigeration circuitry adapted to feed, the appropriate valve means, the source of conditioned liquid, a heating circuitry adapted to feed via appropriate valve means, the source of conditioned liquid as an alternative with respect to said refrigerating circuitry, control and selection means for the source of the conditioned liquid to switch it from and to said heating circuitry or said refrigerating circuitry, and a common feed for the liquid to be conditioned (that is to be either heated or cooled) respectively, to said heating circuitry and to said refrigerating circuitry.

A more recent hot/cold beverage brewing device is disclosed in a U.S. Pat. No. 5,724,883 of Usherovich. As disclosed therein a brewing device is provided which includes a conventional brewing assembly and a cooling assembly for brewing a hot beverage and then dispending the beverage as a hot beverage or diverting it to the cooling system to dispense it as a cold beverage. A switching assembly is provided to permit the user to selectively choose between a hot beverage and cold beverage. The device also provides a novel cooling cartridge which permits the introduction of hot liquid and results in the dispensing of cold liquid from the cold cartridge.

Finally, a thermoelectrically heated/cooled cup holder system is shown in a Schafer U.S. Pat. No. 7,089,749. As disclosed, a system for retaining and controlling the temperature of a beverage suitable for installation in an automobile includes a generally cylindrical, open-topped heat-conductive expandable cup holder, a heat-conductive liner, one or more thermoelectric devices located on a vertical exterior side of the cup holder, a heat sink contacting the thermoelectric device and thermally insulated from the cup holder, and a switch. The placement of the thermoelectric device and an improved arrangement for contact between the cup holder and the cup enable more efficient heat transfer.

Notwithstanding the above, it is presently believed that there is a need and a potential commercial market for an improved thermal conducting cup and holder in accordance with the present invention. There should be a need and a commercial market for such devices because they are specifically designed for use with a laptop or PC so that an individual can keep their beverage hot or cold when they are using their computer without interrupting their work on the computer. Further, the device in accordance with the present invention requires a relatively small current to maintain the beverage at a cold or hot temperature without requiring an individual to reheat or maintain a cold drink at a predetermined temperature. It is also believed that the device as disclosed herein can be manufactured at a competitive price and that such devices are relatively sturdy and would require little or no maintenance or repair.

BRIEF SUMMARY OF THE INVENTION

In essence, the present invention contemplates a thermally conductive cup and holder for maintaining a temperature of a beverage in a cup. The cup and holder comprise:

a hollow receptacle having an open top, a closed bottom and an upper and a lower portion between said top and said bottom of the receptacle;

the upper portion is preferably made of a thermally insulating material while the lower portion and bottom of the receptacle are made of a thermally conductive material such as Aluminum;

the cup holder includes a heat conductive liner for engaging the lower portion and bottom of the cup.

Further, the thermal electric device adjacent to the heat conductive layer is connected to a first source of electrical energy for energizing the thermal electric device. A switch for heating or cooling the thermal electric device and for maintaining the temperature of a beverage in the receptacle is provided.

A second switch for selecting heating or cooling a hot or cold beverage is also provided.

The invention will now be described in connection with the accompanying figures wherein like reference numerals have been used to indicate like parts.

DESCRIPTION OF THE PREFERRED EMBODIMENTS OF THE INVENTION

Figure 1:
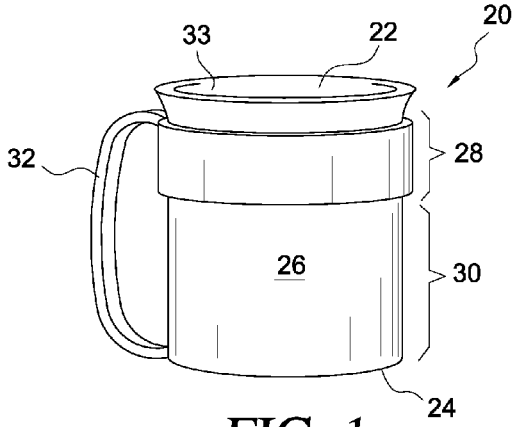
FIG. 1 is a side elevational view of a cup or mug as used in a combination in accordance with the present invention.

As illustrated in FIG. 1, a thermally conductive cup or mug 20 includes an open top 22, a closed bottom 24 and a generally upwardly extending cylindrical wall 26. The cup 20 is formed of a thermally conductive material such as aluminum and includes an upper portion 28 (FIG. 1 and FIG. 2) and lower portion 30. The bottom and upwardly extending cylindrical wall is preferably made of aluminum metal with a bottom 24 and a lower portion 30 exposed for contact with a holder 40 as show in FIG. 2.

The mug 20 also includes an upper portion 34 that includes a layer of a thermally insulating material such as porcelain or other ceramic material, extending around the upper portion 28 that can be held by an individual without discomfort from a hot or cold surface. A ceramic handle 32 extends from an upper portion 28 to the lower portion 30 for holding the cup or mug. This handle is also preferably made of ceramic material that is insulated from a lining 33. A porcelain layer is basically of a fine grain, non-porous ceramic layer that consists essentially of kaolin, quartz and feldspar that is fired at high temperature or other ceramic material.

The holder 40 for maintaining the temperature of a beverage contained in the cup or mug 20 includes a base or bottom 24 and an engaging portion 44 that is brought into contact with the lower portion 30 and bottom 24 of the mug 20 for maintaining the temperature of a beverage contained by the mug 20. The holder 40 is not designed to raise or lower the temperature of the beverage but intended to add sufficient heat or cooling to maintain the temperature of a hot or cold beverage for several hours.

Figure 2:
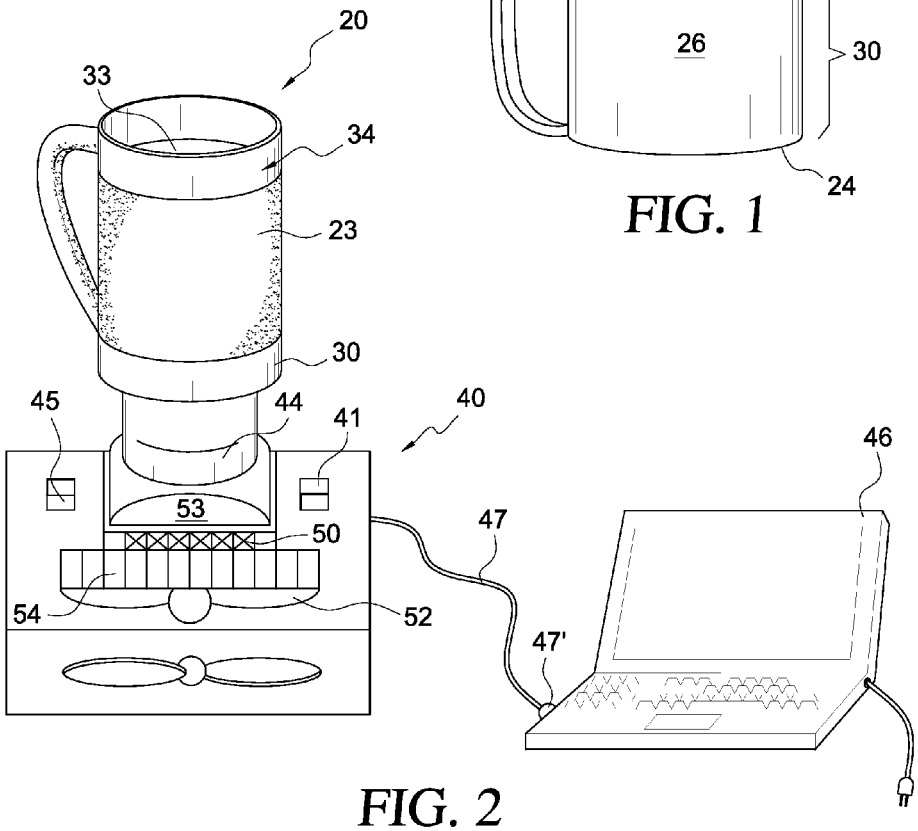
FIG. 2 is a side elevational view of a thermally conductive cup and holder in accordance with the present invention.

As illustrated in FIG. 2 the thermally conductive cup 20 is disposed in a cup holder 40. The holder 40 includes a first switch 41 for energizing the holder to maintain the temperature of a beverage in the cup or mug 20. For example, the holder 40 includes a cup or mug engaging portion 44 that is in contact with the lower portion 30 and bottom of the cup or mug for maintaining the temperature of the beverage relatively constant for up to three or even more hours. In this way, an individual can continue to work on their computer, sip their drink and have it at the same temperature as originally selected. As shown in FIG. 2 the holder 40 also has a second switch 45 for selected a heating and/or cooling effect by the thermal electric device as will be described hereinafter.

Figure 3:
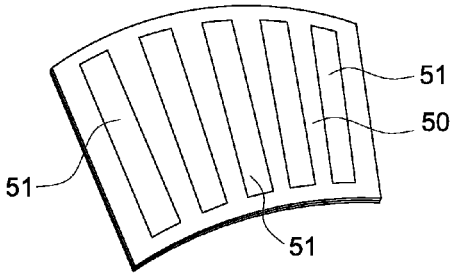
FIG. 3 is a schematic illustration of a somewhat flexible liner for heating or cooling a beverage in a cup.

Further, the holder 40 is connected to a laptop computer 46 by means of a cable 47 and USB connector 47'. As illustrated in FIG. 3 a plurality of engagement members 51 are heated or cooled by a Peltier device as shown in FIG. 2 and is maintained in contact with the lower portion of the mug or cup.

A thermal electric or Peltier device 53 is disposed in a lower portion of the holder 40 and heats and/or cools a liner or engaging portion 51 The Peltier device may be any suitable conventional available device that will operate at low voltage with low current. For example, the device will typically include a plurality of ceramic plates separated by an array of bismuth telluride elements 50 or the like. When a direct current is applied in a given polarity across the Peltier thermoelectric device 53 heat is transferred from one of the ceramic plates (the source) to the other (the sink) cooling the source side and heating the sink side. If the plurality of the current is reversed, the flow of heat is reversed. This reversibility of the direction of heat flow as well as the compact nature of the device makes thermoelectric devices ideal for the present application. Such devices are well known and readily available in the commercial market place.

A single thermoelectric device may be disposed adjacent the liner for use with a cup or cup holder. However, using multiple thermoelectric devices as shown in FIG. 3 improves the heating and cooling efficiency. Further, each thermoelectric device is equipped with a cooling fan 52 or heat sink 54 that is formed of aluminum or an alloy thereof. Further, adequate fan capacity is provided to assure adequate heat dissipation.

While the invention has been described in connection with its preferred embodiments it should be recognized that changes and modifications may be made therein without departing from the scope of the appended claims.

What is claimed is:

1. A thermally conductive cup and holder for maintaining a temperature of a beverage in said cup, said cup and holder consisting of:

an open cup consisting of an open top, a flat closed bottom and a right circular cylindrical upper portion and a right circular cylindrical lower portion of a smaller diameter than said upper portion between said top and said bottom and wherein said lower portion and said bottom of said cup are aluminum and said upper portion of said cup is aluminum with a layer of porcelain on an outer surface thereof with a height of said porcelain layer of about 3½ inches and a thickness of about ¼ inch;

a cup holder including a heat conductive liner engaging said lower portion and said bottom of said cup;

multiple thermoelectric devices adjacent said conductive liner connected to a first source of electrical energy for energizing said thermoelectric devices; and a first switch for operatively connecting said thermoelectric device to the first source of electrical energy and a second switch configured to have a heating position representing a first polarity of the first source of electrical energy across the thermoelectric device for heating the cup holder and a cooling position representing a second polarity for cooling of the cup holder; and wherein said holder does not raise or lower the temperature of the beverage but adds sufficient heat or cooling to maintain the temperature of a hot or cold beverage for several hours;

multiple fans disposed below said cup holder for directing a flow of air around said cup and holder when said second switch is in the cooling position; and wherein each thermoelectric device is equipped with a cooling fan to provide adequate fan capacity to assure adequate heat dissipation; and a computer and a USB connector and wire connecting said thermoelectric device to said computer as the first source of electrical energy and means connecting said computer to a second source of electrical energy.

* * * * *